US008115387B2

(12) United States Patent
Sasaki et al.

(10) Patent No.: US 8,115,387 B2
(45) Date of Patent: Feb. 14, 2012

(54) PLASMA DISPLAY PANEL

(75) Inventors: Takashi Sasaki, Hiratsuka (JP); Akira Otsuka, Zama (JP)

(73) Assignee: Hitachi, Ltd., Tokyo (JP)

( * ) Notice: Subject to any disclaimer, the term of this patent is extended or adjusted under 35 U.S.C. 154(b) by 121 days.

(21) Appl. No.: 12/594,027

(22) PCT Filed: Mar. 30, 2007

(86) PCT No.: PCT/JP2007/000350

§ 371 (c)(1),
(2), (4) Date: Nov. 10, 2009

(87) PCT Pub. No.: WO2008/126147

PCT Pub. Date: Oct. 23, 2008

(65) Prior Publication Data

US 2010/0084975 A1 Apr. 8, 2010

(51) Int. Cl.
*H01J 17/49* (2006.01)

(52) U.S. Cl. ..... 313/586; 313/582

(58) Field of Classification Search ..... 313/582–587
See application file for complete search history.

(56) References Cited

U.S. PATENT DOCUMENTS

| | | | |
|---|---|---|---|
| 2004/0124775 | A1 | 7/2004 | Okada et al. |
| 2005/0035713 | A1* | 2/2005 | Yoo ..... 313/582 |
| 2005/0231114 | A1 | 10/2005 | Mizuta |
| 2006/0145626 | A1 | 7/2006 | Sasaki |
| 2006/0220998 | A1 | 10/2006 | Sasaki et al. |
| 2006/0244380 | A1 | 11/2006 | Yoshinari et al. |

FOREIGN PATENT DOCUMENTS

| | | |
|---|---|---|
| JP | 2003-257321 | 9/2003 |
| JP | 2004-200040 | 7/2004 |
| JP | 2004-273265 | 9/2004 |
| JP | 2005-310785 | 11/2005 |
| JP | 2006-185903 | 7/2006 |
| JP | 2006-286250 | 10/2006 |
| JP | 2006-294461 | 10/2006 |
| JP | 2006-302866 | 11/2006 |

OTHER PUBLICATIONS

International Preliminary Report on Patentability, with English translation, issued in International Patent Application No. PCT/JP2007/000350, mailed Oct. 15, 2009.

* cited by examiner

*Primary Examiner* — Anne Hines
(74) *Attorney, Agent, or Firm* — McDermott Will & Emery LLP

(57) ABSTRACT

A plasma display panel includes a first and a second plate facing each other via a discharge space. On the first plate, a first and a second bus electrode are provided which extend in a first direction and are disposed at intervals. In a cell, a first and a second display electrode are provided and coupled to the first and the second bus electrode respectively, and facing each other. In addition, on a dielectric layer covering the first and the second bus electrode and the first and the second display electrode, a plurality of address electrodes are provided which are disposed at respective positions facing first barrier ribs. Then, a protective layer is formed directly on the address electrodes and the dielectric layer, covering a surface of the dielectric layer and the address electrodes, and being exposed to the discharge space of the cell.

8 Claims, 15 Drawing Sheets

PLASMA DISPLAY PANEL

CROSS-REFERENCE TO RELATED APPLICATIONS

This application is a U.S. National Stage application claiming the benefit of prior filed International Application Number PCT/JP2007/000350, filed Mar. 30, 2007, the entire contents of which are incorporated herein by reference.

TECHNICAL FIELD

The present invention relates to a plasma display panel used for a display device.

BACKGROUND ART

A plasma display panel (PDP) is configured with two glass plates adhering to each other, and displays an image with discharge light emitted in a space formed between the glass plates. A cell corresponding to a pixel of the image is a self-luminescence type and coated with phosphors which emit visible lights of red, green and blue under ultraviolet rays emitted by the discharge.

A three-electrode structure PDP displays an image by generating sustain discharge between an X-electrode and Y-electrode. A cell to generate the sustain discharge (cell to be lighted) is selected by selectively generating address discharge, for example, between the Y-electrode and an address electrode.

In a typical PDP, the X-electrode and the Y-electrode are disposed on a front glass plate and the address electrode is disposed on a back glass plate. In addition, there has been recently proposed a PDP in which the three electrodes of the X-electrode, the Y-electrode, and the address electrode are disposed on the front glass plate (refer to Patent document 1, for example). The PDP having the three electrodes on the front glass plate typically includes a first dielectric layer which covers the X-electrode and the Y-electrode and a second dielectric layer which covers the address electrode provided on this first dielectric layer. Then, on this second dielectric layer, a protective layer is provided for protecting the dielectric layer from an ion collision caused by the discharge.

Patent document 1: Japanese Unexamined Patent Application Publication No. 2003-257321.

DISCLOSURE

Problem to be Solved

In the conventional PDP having the three electrodes on the front glass plate, the two dielectric layers are formed on the X-electrode and the Y-electrode, and thereby the production process is increased for forming the dielectric layers on the front glass plate. In addition, the thickness of the total dielectric layer is increased by the formation of the two dielectric layers, and thereby a voltage to be applied between the X- and Y-electrodes is increased for generating the sustain discharge.

Further, in the conventional PDP having the three electrodes on the front glass plate, the Y-electrodes of cells on both sides of the address electrode are close in distance to the address electrode disposed between the cells, and thereby there is a probability of erroneous discharge in the adjacent cell when address discharge is generated between the Y-electrode and the address electrode.

A proposition of the present invention is to reduce the production process for the PDP having the three electrodes on the front glass plate. Further, a proposition of the present invention is to suppress increase in the power consumption of the PDP having the three electrodes on the front glass plate by reducing the driving voltage between the X- and Y-electrodes. Further, a proposition of the present invention is to prevent the erroneous discharge in the adjacent cell when the address discharge is carried out in the PDP having the three electrodes on the front glass plate.

Means for Solving the Problems

A plasma display panel includes a first plate and a second plate facing each other via a discharge space. On the first plate, a first bus electrode and a second bus electrode are provided which extend in a first direction and are disposed at intervals. On the second plate, a plurality of first barrier ribs are provided which extend in a second direction perpendicular to the first direction and are disposed at intervals. Further, a cell is formed in a region surrounded by the first bus electrode, the second bus electrode, and the first barrier ribs adjacent to each other.

In the cell, a first display electrode is provided which is coupled to the first bus electrode, and extends from the first bus electrode toward the second bus electrode. Further, in the cell, a second display electrode is provided which is coupled to the second bus electrode, extends from the second bus electrode toward the first bus electrode, and includes an opposed part to the first display electrode.

Further, on the first plate, a dielectric layer is provided which covers the first bus electrode, the second bus electrode, the first display electrode, and the second display electrode, and on the dielectric layer, a plurality of address electrodes are provided which are disposed at respective positions facing the first barrier ribs. In addition, on the dielectric layer, a protective layer is provided which covers a surface of the dielectric layer and the address electrodes, and is exposed to the discharge space of the cell.

Effect

The present invention can reduce the production process for the PDP having the three electrodes on the front glass plate. In addition, the present invention can suppress increase in the power consumption of the PDP having the three electrodes on the front glass plate by reducing the driving voltage between the X- and Y-electrodes. Further, the present invention can prevent erroneous discharge in the adjacent cell when address discharge is carried out in a PDP having three electrodes on a front glass plate.

DETAILED DESCRIPTION OF THE EMBODIMENTS

Hereinafter, embodiments of the present invention will be explained with reference to the drawings.

Figure 1:
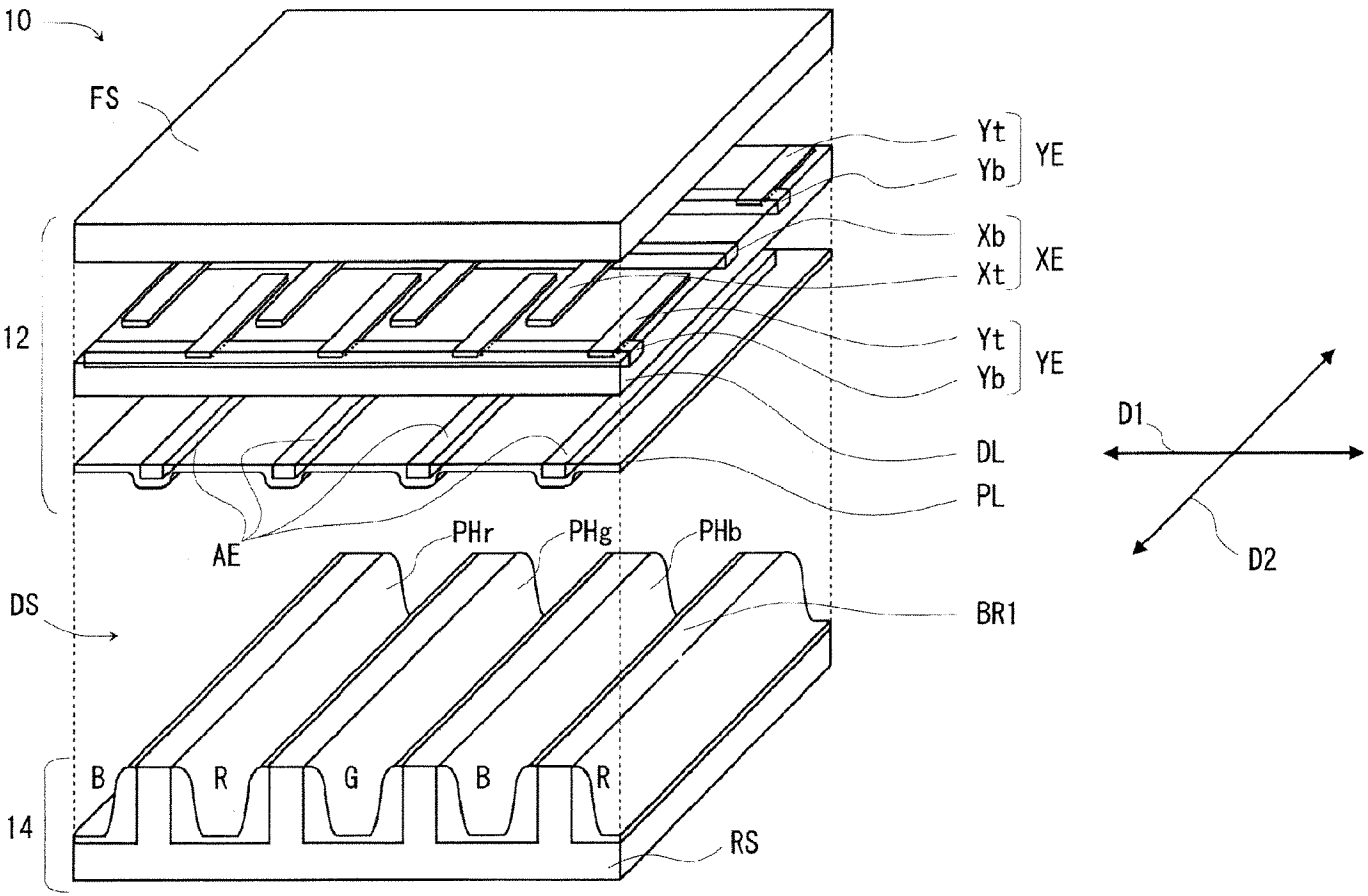
FIG. 1 is an exploded perspective view showing a first embodiment of the present invention.

FIG. 1 shows a first embodiment of the present invention. The arrow D1 in the drawing shows a first direction D1 and the arrow D2 shows a second direction D2 which crosses the first direction D1 perpendicularly in the plane parallel to an image display surface. A plasma display panel 10 (hereinafter, also called PDP) is configured with a front plate part 12 forming the image display surface and a back plate part 14 facing the front plate part 12. The front plate part 12 and the back plate part 14 form a discharge space DS therebetween (in more detail, in a concave part of the back plate part 14).

The front panel part 12 has an X-bus electrode Xb (first bus electrode) and a Y-bus electrode Yb (second bus electrode) which are formed on a glass base FS (first plate) (lower side in the drawing) in parallel to the first direction D1 and disposed alternately along the second direction D2, for generating the discharge repeatedly. The X-bus electrode Xb is coupled with an X-transparent-electrode Xt (first display electrode) which extends from the X-bus electrode Xb toward the Y-bus electrode Yb in the second direction D2. Further, the Y-bus electrode Yb is coupled with a Y-transparent-electrode Yt (second display electrode) which extends from the Y-bus electrode Yb toward the X-bus electrode Xb in the second direction D2.

Here, the X-bus electrode Xb and the Y-bus electrode Yb are opaque electrodes made of a metal material or the like, and the X-transparent-electrode Xt and the Y-transparent-electrode Yt are transparent electrodes which are made of ITO films or the like and transmit light. The transparent electrodes Xt and Yt are sometimes disposed over the whole areas between the respectively adhering bus electrodes Xb and Yb and the glass base FS. Further, the transparent electrodes Xt and Yt may be formed integrally with the bus electrodes Xb and Yb using the same material (metal material or the like) as that of the bus electrodes Xb and Yb. Then, an X electrode XE (sustain electrode) is configured with the X-bus electrode Xb and the X-transparent-electrode Xt, and a Y electrode YE (scan electrode) is configured with the Y-bus electrode Yb and the Y-transparent-electrode Yt.

The electrodes Xb, Xt, Yb and Yt are covered by a dielectric layer DL. For example, the dielectric layer DL is a silicon dioxide film (film of $SiO_2$, film of silicon dioxide) formed by a CVD method. Then, on the dielectric layer DL (lower side in the drawing) is provided a plurality of address electrodes AE which extend in the direction perpendicular to the bus electrodes Xb and Yb (second direction D2). The address electrode AE and the surface of the dielectric layer DL are covered by a protective layer PL such as an MgO film or the like. The protective layer PL is exposed to a discharge space DS and protects the address electrode AE and the dielectric layer DL from the ion collision caused by the discharge. That is, in this embodiment, the second dielectric layer is not formed for covering the address electrode AE, and the protective layer PL is formed directly on the address electrode AE and the first dielectric layer DL.

The back plate part 14, which faces the front plate part 12 via the discharge space DS, includes first barrier ribs BR1 formed on a glass base RS (second plate) in parallel to each other. The barrier rib BR1 extends in the direction perpendicular to the bus electrodes Xb and Yb (second direction D2) and faces the address electrode AE. In other words, the address electrode AE is disposed at a position facing the barrier rib BR1. The barrier rib BR1 forms a side wall of a cell. Further, on the side of the barrier rib BR1, and on the glass base RS between the barrier ribs adjacent to each other, phosphors PHr, PHg, and PHb are coated which emit visible lights of red (R), green (G), and blue (B) respectively, by the excitation of the ultraviolet ray.

One pixel of the PDP 10 is configured with three cells which emit the red, green, and blue light, respectively. Here, one cell (pixel of one color) is formed in the discharge space DS defined by the bus electrodes Xb and Yb and the barrier ribs BR1. In this manner, the PDP 10 has the cells disposed in a matrix for displaying an image and also configured with alternately disposed plural kinds of cells which emit light with colors different from each other. While not illustrated particularly in the drawing, a display line is configured with the cells formed along the bus electrodes Xb and Yb.

The PDP 10 is made up by adhering the front plate part 12 and the back plate part 14 together so that the protective layer PL and the barrier rib BR1 contact each other, and encapsulating discharge gas such as Ne, Xe, etc. into the discharge space DS.

Figure 2:
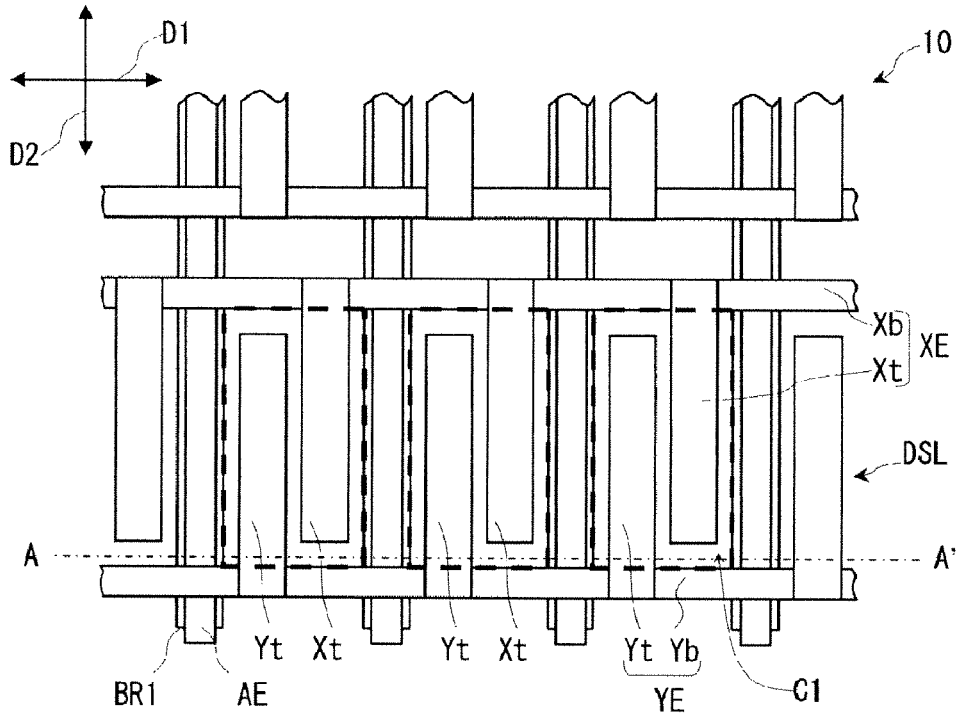
FIG. 2 is an explanatory diagram of a main part in the PDP shown in FIG. 1.
Figure 3:
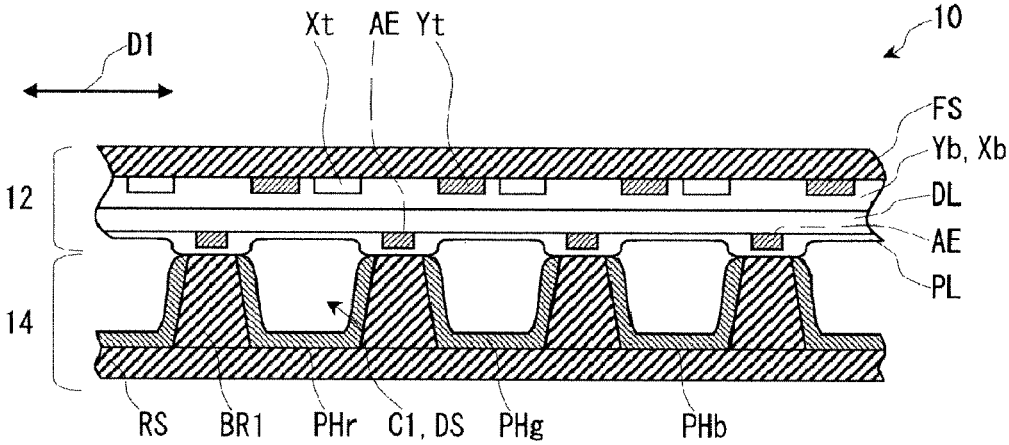
FIG. 3 is a cross-sectional view of a main part in the PDP shown in FIG. 1.

FIG. 2 and FIG. 3 show a main part of the PDP 10 shown in FIG. 1. FIG. 2 shows a state of the electrodes Xb, Yb, Yt, and AE and the barrier rib BR1 viewed from the image display surface side (upper side in FIG. 3). FIG. 3 shows a cross-section taken along the A-A' line in FIG. 2.

When viewed from the image display surface side, the address electrode AE is provided at a position overlapping the barrier rib BR1. As described above, the cell C1 is formed in the region surrounded by the bus electrodes Xb and Yb and the barrier ribs BR1 (region surrounded by the bold broken line in FIG. 2).

The X-transparent-electrode Xt and the Y-transparent-electrode Yt are provided for each cell C1 and face each other along the second direction D2. Further, when viewed from the image display surface side, the transparent electrode Yt faces the address electrode AE positioned in the left thereof. Accordingly, by applying a voltage between the address electrode AE and the transparent electrode Yt, it is possible to generate address discharge in the discharge space DS of the focused cell C1. At this time, the barrier rib BR1 works as a part of the dielectric layer and an electric field is generated in the discharge space DS between the address electrode AE and the transparent electrode Yt.

Further, as shown in FIG. 3, the dielectric layer DL and the protective layer PL are formed between the transparent electrodes Xt and Yt and the discharge space DS. In other words, the protective layer PL is disposed contacting the dielectric layer DL and covers the surface of the dielectric layer DL and the address electrode AE and exposed to the discharge space DS of the cell C1. A wall charge necessary for the discharge (sustain discharge) during the sustain period of FIG. 7 to be described hereinafter is stored on the surface of the protective layer PL at positions corresponding to the transparent electrodes Xt and Yt. The PDP 10 has only one dielectric layer DL for the dielectric layer on the transparent electrodes Xt and Yt and thereby can reduce the production process compared to the PDP having two dielectric layers formed on the transparent electrodes Xt and Yt.

Moreover, the PDP 10 has only one dielectric layer DL as the dielectric layer and thereby can reduce the thickness of the total dielectric layer compared to a PDP having two dielectric layers formed on the transparent electrodes Xt and Yt, and can increase an electric field strength generated between the transparent electrodes Xt and Yt. Accordingly, the PDP 10 can store a larger amount of wall charge on the surface of the protective layer PL at the positions corresponding to the transparent electrodes Xt and Yt, and can reduce the voltage to be applied between the transparent electrodes Xt and Yt for generating the sustain discharge. As a result, it is possible to reduce the driving voltage between the scan electrode YE and the sustain electrode XE to suppress the increase of the power consumption.

Further, the transparent electrodes Xt and Yt disposed along the display line DSL are disposed alternately along the first direction D1. Accordingly, in a pair of the cells C1 adjacent to each other in the first direction sandwiching the address electrode AE, the transparent electrode Yt (scan electrode) in one of the cells C1 neighbors the address electrodes AE on one side in the first direction D1 (right side in the drawing), and the transparent electrode Xt (sustain electrode) of the other cell C1 neighbors the address electrode AE on the other side in the first direction D1 (left side in the drawing). In other words, in the pair of cells C1 adjacent to each other in the first direction D1 sandwiching the address electrode AE, the address electrode AE faces only the transparent electrode Yt on one side.

Accordingly, when generating the address discharge between the address electrode AE and the transparent electrode Yt of the focused cell C1 (address period), it is possible to prevent the erroneous discharge from occurring in the adjacent cell C1. Thereby, even in the case that the position of the address electrode AE is shifted from the center of the barrier rib BR1 to the opposite direction of the corresponding transparent electrode Yt (to the side of the transparent electrode Xt) when the front plate part 12 and the back plate part 14 are put together, the erroneous discharge is not generated in the adjacent cell C1. Accordingly, a higher assembly accuracy is not necessary for making the front plate part 12 and the back plate part 14 to adhere to each other in the PDP having three electrodes on the glass base FS (front glass plate), and it is possible to simplify the assembly process.

Figure 4:
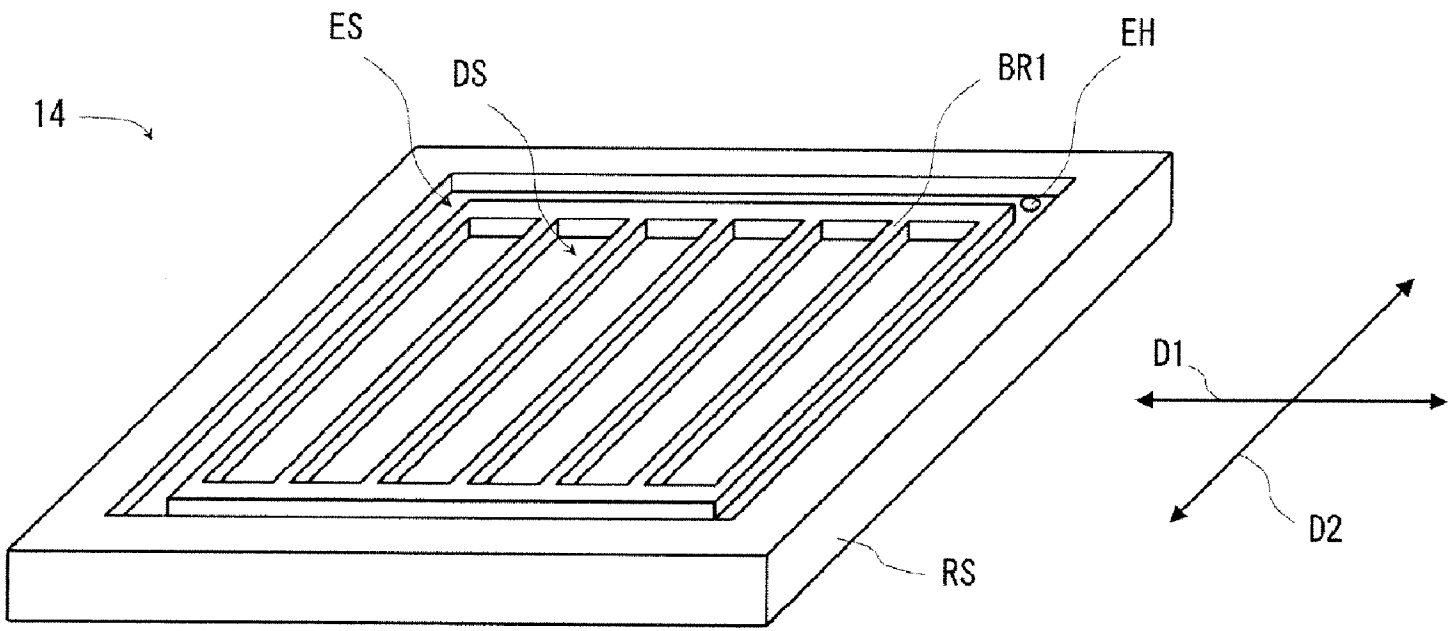
FIG. 4 is an explanatory diagram showing an outline of the back plate part shown in FIG. 1.

FIG. 4 shows an outline of the back plate part 14 shown in FIG. 1. In the periphery of the glass base RS, there is provided an exhaust hole EH passing through the glass base RS from the exhaust space ES to the outside surface. Thereby, the discharge space DS of the assembled PDP can be set to a vacuum state and the discharge gas can be encapsulated into the discharge space DS. Further, the discharge space DS and the exhaust space ES are formed by direct engraving of the glass base RS using a sandblast method or the like. That is, the barrier rib BR1 is formed by the direct engraving of the glass base RS. Thereby, the production cost of the PDP can be reduced because a baking process is not necessary for forming the barrier rib BR1, for example. In many cases, a baking furnace for this baking process uses electricity as energy and omitting of this baking process also reduces the electric energy. The discharge space DS may be formed through the processes of coating of paste-state barrier rib material, drying, sandblasting, and baking. Further, the barrier rib BR1 may be formed by the accumulation of printed layers.

Figure 5:
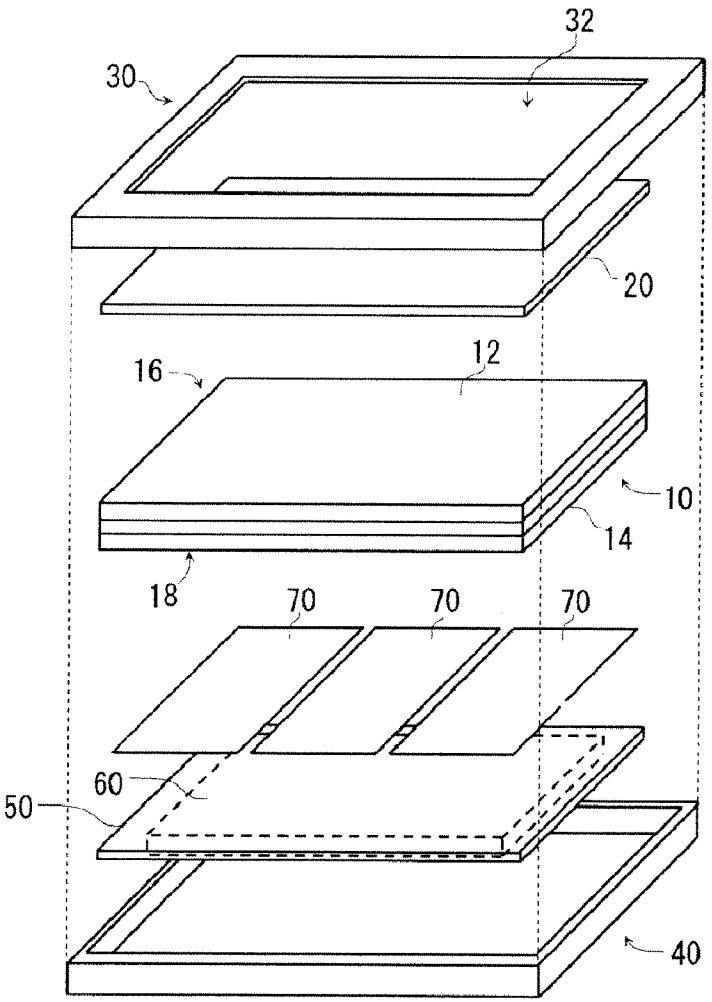
FIG. 5 is an exploded perspective view showing an example of a plasma display device configured by using the PDP shown in FIG. 1.

FIG. 5 shows an example of a plasma display device configured by using the PDP 10 shown in FIG. 1. The plasma display device (hereinafter, also called PDP device) includes the PDP 10, an optical filter 20 provided on the image display surface 16 side (light output side) of the PDP 10, a front case 30 disposed on the image display surface 16 side of the PDP 10, a rear case 40 and a base chassis 50 disposed on a rear plane 18 side of the PDP 10, a circuit unit 60 attached on the rear case 40 side of the base chassis 50 for driving the PDP 10, and a double-faced adhesive sheet 70 for adhering the PDP 10 to the base chassis 50. The circuit unit 60 is configured with a plurality of components and thereby shown by a broken-line box in the drawing. The optical filter 20 is adhered on a protection glass (not shown in the drawing) which is attached to an opening part 32 of the front case 30. The optical filter 20 is sometimes provided with an electromagnetic wave shielding function. Further, the optical filter 20 is sometimes adhered directly on the image display surface 16 side of the PDP 10 instead of the protection glass.

Figure 6:
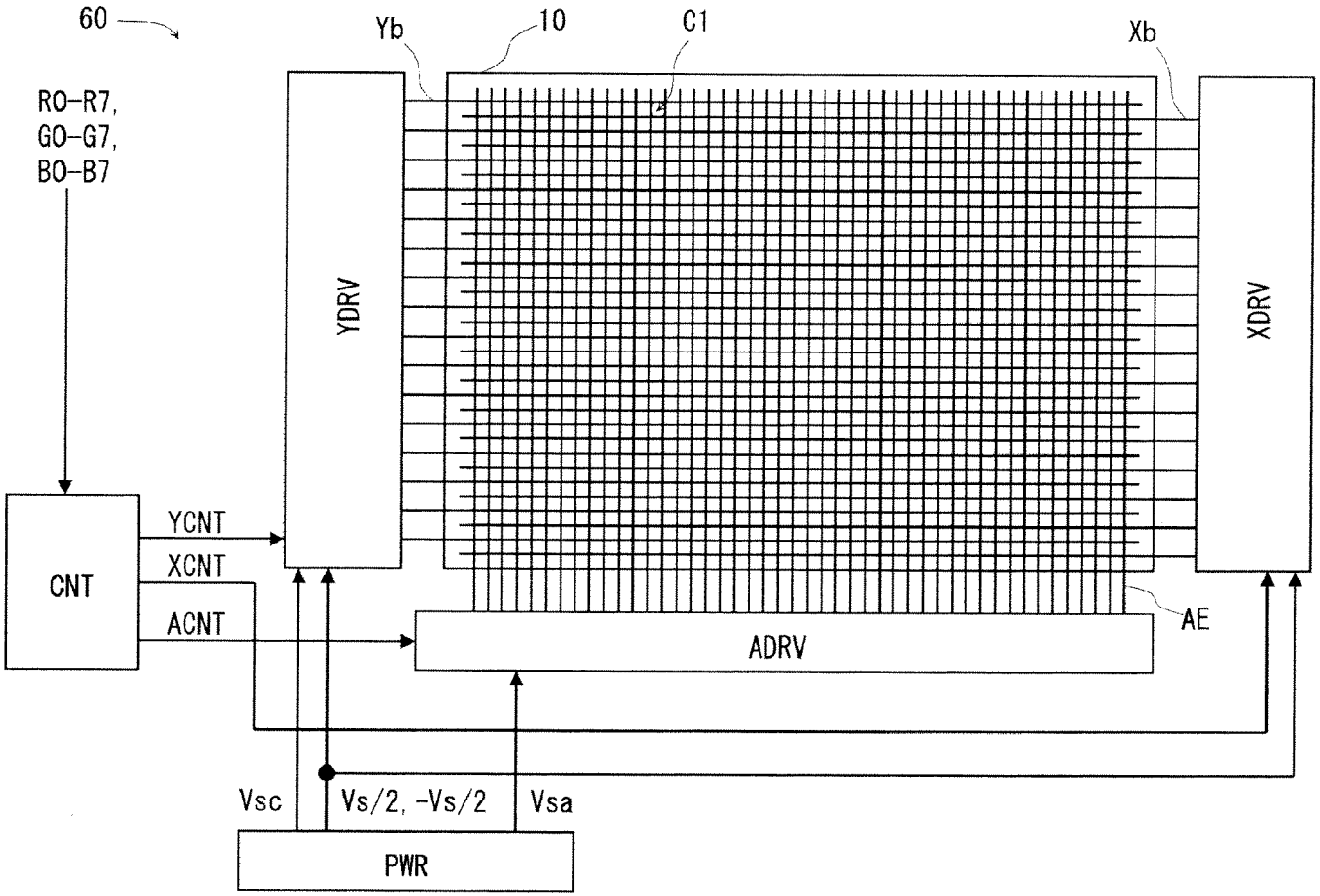
FIG. 6 is a block diagram showing an outline of the circuit unit shown in FIG. 5.

FIG. 6 shows an outline of the circuit unit 60 for driving the PDP 10 shown in FIG. 1. The circuit unit 60 includes an X-driver XDRV applying a common pulse to the bus electrodes Xb, a Y-driver YDRV selectively applying a pulse to the bus electrode Yb, an address driver ADRV selectively applying a pulse to the address electrode AE, a control unit CNT controlling the operation of the drivers XDRV, YDRV, and ADRV, and a power supply unit PWR. The drivers XDRV, YDRV, and ADRV operate as a driver unit driving the PDP 10. The power supply unit PWR generates power supply voltages Vsc, Vs/2, −Vs/2, Vsa, etc. to be supplied to the drivers YDRV, XDRV, and ADRV.

The control unit CNT selects a subfield to be used according to image data R0-7, G0-7, and B0-7, and outputs control signals YCNT, XCNT, and ACNT to the drivers YDRV, XDRV, and ADRV, respectively. Here, the subfield is a field divided from one filed for displaying one screen of the PDP 10, and the number of times of sustain discharge is determined for each subfield. Then, a multiple gradation image is displayed by selection of the subfield to be used for each cell C1 composing the pixel.

Figure 7:
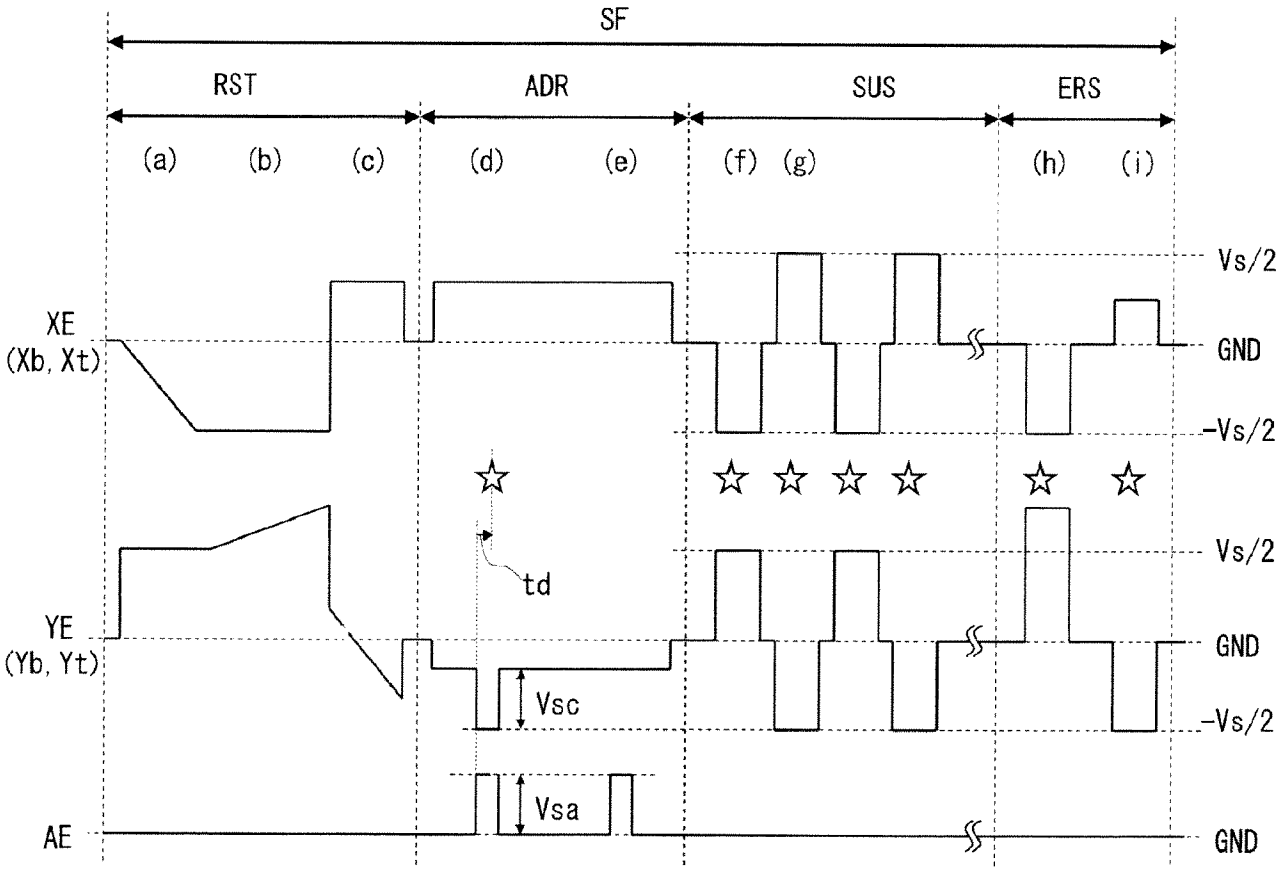
FIG. 7 is a waveform chart showing an example of subfield discharge operation for displaying an image on the PDP shown in FIG. 1.

FIG. 7 shows an example of the discharge operation in the subfield for displaying an image on the PDP 10 shown in FIG. 1. The star sign in the drawing shows generation of the discharge. Each of the subfields SF is configured with a reset period RST, an address period ADR, a sustain period SUS, and an erase period ERS. The erase period ERS is a period for generating discharge for reducing wall charge only in the lighted cell and thereby sometimes defined as one included in the sustain period SUS.

First, in the reset period RST, a gradually decreasing negative voltage (slope pulse) is applied to the sustain electrode XE (bus electrode Xb and transparent electrode Xt), and a positive voltage is applied to the scan electrode YE (bus electrode Yb and transparent electrode Yt) (FIG. 7(*a*)). Then, the sustain electrode XE is maintained to have a negative write voltage and a gradually increasing positive write voltage (write slope pulse) is applied to the scan electrode YE (FIG. 7(*b*)). Thereby, positive and negative wall charges are stored in the sustain electrode XE and the scan electrode YE, respectively, while cell luminescence is being suppressed. Next, a positive adjusting voltage is applied to the sustain electrode XE and a negative adjusting voltage (adjusting slope pulse) is applied to the scan electrode YE (FIG. 7(*c*)). Thereby, the amounts of the positive and negative wall charges which have been stored in the sustain electrode XE and the scan electrode YE, respectively, are reduced and also the wall charge amounts of all the cells become equal. The positive adjusting voltage is a voltage smaller than the voltage Vs/2 and the minimum value of the negative adjusting voltage is a voltage larger than the voltage −Vs/2, for example.

In the address period ADR, a scan voltage which becomes anode in the address discharge is applied to the sustain electrode XE, a scan pulse which becomes cathode in the address discharge is applied to the scan electrode YE, and an address pulse (voltage Vsa) which becomes anode in the address discharge is applied to the address electrode AE which corresponds to the cell to be lighted (FIG. 7(*d*)). The cell selected by the scan pulse and the address pulse has discharge temporarily. That is, a voltage larger than a minimum voltage for generating the discharge (firing voltage) is applied between the scan electrode YE and the address electrode AE, and a voltage smaller than the firing voltage is applied between the sustain electrode XE and the address electrode AE. Thereby, as described in above FIG. 2, the erroneous discharge is prevented from occurring between the sustain electrode XE of the adjacent cell and the address electrode AE when the address discharge is generated between the address electrode AE and the scan electrode YE of the focused cell. Time td (discharge time lag in address period ADR) is a time from when a scan pulse is applied to the scan electrode YE until address discharge is generated. The second address pulse shown in the waveform at the address electrode AE is applied for selecting a discharge cell in another display line (FIG. 7(*e*)).

In the sustain period SUS, negative and positive sustain pulses are applied to the sustain electrode XE and the scan electrode YE, respectively (FIG. 7(*f*) and FIG. 7(*g*)). Thereby, the discharge state of the lighted cell is maintained. The sustain pulses having polarities different from each other are repeatedly applied to the sustain electrode XE and the scan electrode YE, respectively, and thereby the discharge of the cell lighted is repeatedly generated in the sustain period SUS. As described above, in this embodiment, a larger amount of wall charge can be stored on the surface of the protective layer PL at the positions corresponding to the transparent electrodes Xt and Yt because of the thin dielectric layer DL on the transparent electrodes Xt and Yt. As a result, it is possible to reduce the absolute values of the voltages Vs/2 and −Vs/2 to be applied to the scan electrode YE and the sustain electrode XE, respectively.

In the erase period ERS, a negative pre-erase pulse and a positive high voltage pre-erase pulse are applied to the sustain electrode XE and the scan electrode YE, respectively, to generate discharge (FIG. 7(*h*)). Thereby, the wall charge is stored in the sustain electrode XE and the scan electrode YE. At this time, a voltage larger than the voltage $V_{S/2}$ is applied to the scan electrode YE and thereby a relatively large amount of wall charge is stored in the scan electrode YE. Next, a positive erase pulse and a negative erase pulse are applied to the sustain electrode XE and the scan electrode YE, respectively (FIG. 7(*i*)). While discharge is generated thereby, the wall charge amount is reduced compared to that in the sustain period SUS because a voltage value difference applied between the two electrodes is smaller than the voltage value difference in the sustain period SUS.

As described above, the first embodiment does not form the second dielectric layer covering the address electrode AE and forms the protective layer PL directly on the address electrode AE and the first dielectric layer DL. Since two dielectric layers need not be formed, it is possible to reduce the production process.

Further, the thickness of the total dielectric layer formed between the transparent electrodes Xt and Yt and the discharge space DS can be made as same as that of the one dielectric layer DL, and thereby can be made thinner than that of the PDP in which two dielectric layers are formed. Accordingly, this embodiment can store a larger amount of wall charge at the transparent electrodes Xt and Yt and can reduce the voltage to be applied between the transparent electrodes Xt and Yt for generating the sustain discharge. As a result, it is possible to reduce the driving voltage between the scan electrode YE and the sustain electrode XE, and to suppress the increase in the power consumption.

In addition, since the transparent electrodes Xt and Yt are disposed alternately along the first direction D1, in the cells C1 adjacent to each other via the address electrode AE, the transparent electrodes Yt of both cells C1 do not neighbor on the both sides of the one address electrode AE. As a result, it is possible to prevent the erroneous discharge in the cell C1 adjacent via the address electrode AE.

Further, even in the case that the position of the address electrode AE is shifted from the center of the barrier rib BR1 to the opposite side of corresponding transparent electrode Yt (transparent electrode Xt side), the erroneous discharge is not generated between the address electrode AE and the transparent electrode Xt, and thereby a higher assembly accuracy is not necessary for making the front plate part 12 and the back plate part 14 to adhere to each other, resulting in simplifying the assembly process.

Further, since the back plate part 14 is not provided with the address electrode AE, the barrier rib BR1 can be formed by the direct engraving of the glass base RS. Thereby, it is possible to reduce the production cost of the PDP 10 because the baking process is not necessary for forming the barrier rib BR1.

Figure 8:
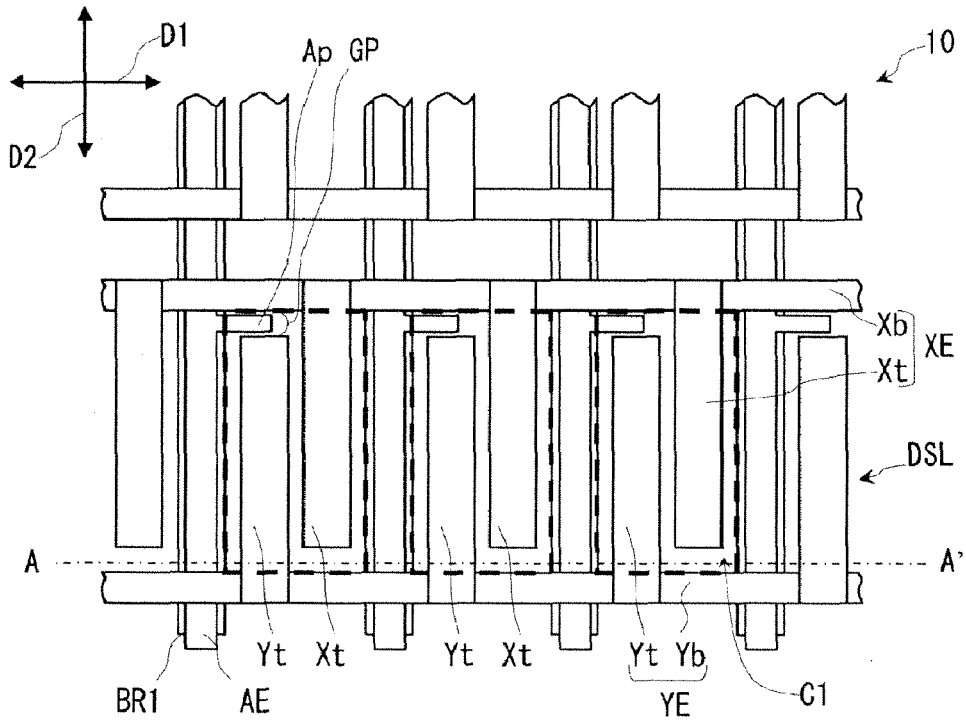
FIG. 8 is an explanatory diagram for a main part of a PDP in a second embodiment of the present invention.
Figure 9:
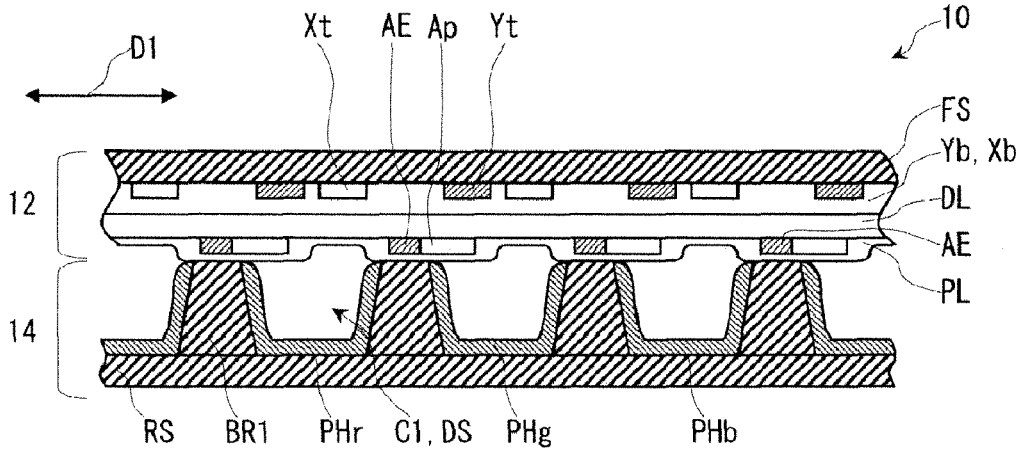
FIG. 9 is a cross-sectional view for a main part of a PDP in the second embodiment of the present invention.

FIG. 8 and FIG. 9 show a main part of a PDP 10 in a second embodiment of the present invention. This embodiment is different from the first embodiment in that a projection part Ap is provided to the address electrode AE. The configuration except the shape of the address electrode AE is the same as that of the first embodiment (FIG. 1 to FIG. 4). The same element described in the first embodiment is denoted by the same symbol and detailed description thereof will be omitted. Further, the discharge operation for displaying an image on the PDP 10 of this embodiment and a PDP device using the PDP 10, is the same as that of the first embodiment (FIG. 5 to FIG. 7) except the voltage values (e.g. voltages Vsc and Vsa shown in FIG. 7).

FIG. 8 shows a state of the electrodes Xb, Xt, Yb, Yt, and AE and the barrier rib BR1 viewed from the image display surface side (upper side in FIG. 9), and FIG. 9 shows a cross-section taken along the A-A' line in FIG. 8.

The projection part Ap is formed integrally with the address electrode AE, projecting from the address electrode AE into a gap GP between an end of the transparent electrode Yt and the bus electrode Xb. That is, the projection part Ap is disposed on the discharge space DS of the cell C1 corresponding to the address electrode AE via the protective layer PL as shown in FIG. 9. Since the projection part Ap is formed on the discharge space DS, the firing voltage can be reduced in generating the discharge between the projection part Ap and the transparent electrode Yt. That is, the voltage applied between the address electrode AE and the transparent electrode Yt, for example, the voltage Vsa shown in FIG. 7, can be reduced. The projection part AP, while disposed close to the bus electrode Xb (sustain electrode), does not generate the erroneous discharge in the address discharge as same as the above described transparent electrode Xt (sustain electrode) of the adjacent cell.

As described above, also in the second embodiment, it is possible to obtain the same effect as that of the first embodiment. Further, in this embodiment, since the discharge is generated between the projection part Ap formed on the discharge space DS and the transparent electrode Yt, it is possible to reduce the voltage to be applied during the address period, for example, the voltage Vsa shown in FIG. 7. As a result, power consumption in the driver circuit of the address electrode AE (e.g. address driver ARDV shown in FIG. 6) can be reduced. In addition, the reduction of the voltage Vsa further suppresses generation of the erroneous discharge in the adjacent cell C1. In the case that the same voltage as that in the first embodiment (e.g. difference between the voltage Vsa and the voltage −Vs/2 shown in FIG. 7) is applied between the address electrode AE and the electrode YE, it is possible to generate the address discharge without fail because the firing voltage is lower than that in the first embodiment.

Figure 10:
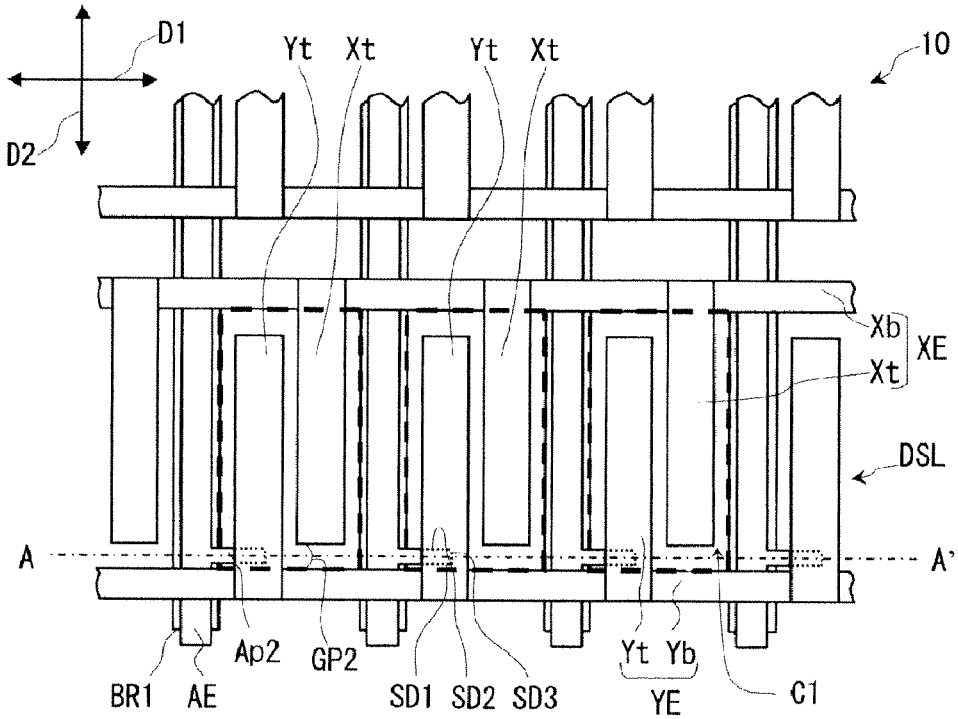
FIG. 10 is an explanatory diagram for a main part of a PDP in a third embodiment of the present invention.
Figure 11:
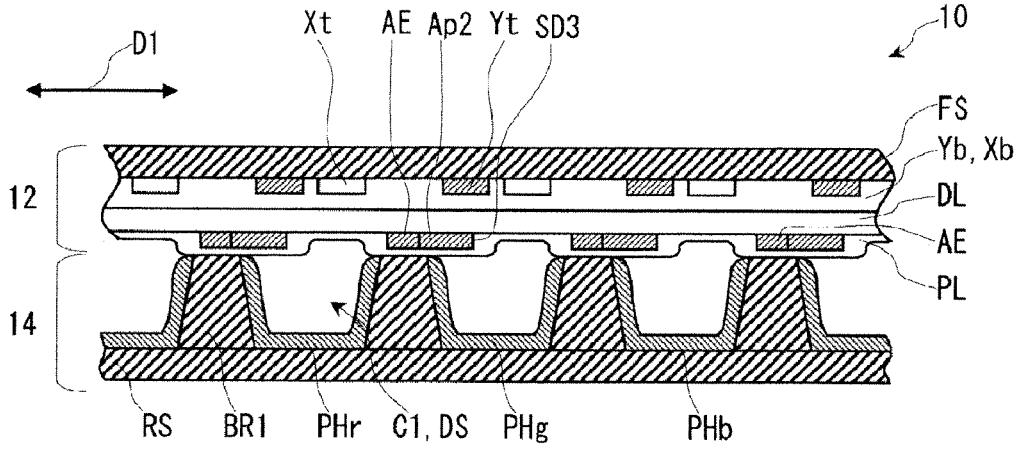
FIG. 11 is a cross-sectional view for a main part of a PDP in the third embodiment of the present invention.

FIG. 10 and FIG. 11 show a main part of a PDP 10 in a third embodiment of the present invention. This embodiment is different from the second embodiment in the position of the projection part Ap2 provided to the address electrode AE. The other configuration is the same as that of the second embodiment. The same element as that described in the first and second embodiments (FIG. 1 to FIG. 4, FIG. 8, and FIG. 9) is denoted by the same symbol, and detailed description thereof will be omitted. Further, the discharge operation for displaying an image on the PDP 10 of this embodiment and a PDP device using the PDP 10 is the same as that in the first embodiment (FIG. 5 to FIG. 7) except the voltage values (e.g. voltages Vsc and Vsa shown in FIG. 7).

FIG. 10 shows a state of the electrodes Xb, Xt, Yb, Yt, and AE and the barrier rib BR1 viewed from the image display surface side (upper side in FIG. 11), and FIG. 11 shows a cross-section taken along the A-A' line in FIG. 10.

The projection part Ap2 is formed integrally with the address electrode AE, projecting from the address electrode AE toward a gap GP2 between an end of the transparent electrode Xt and the bus electrode Yb. A part of the projection part Ap2 (broken line part in FIG. 10) faces the transparent electrode Yt via the dielectric layer DL as shown in FIG. 11. Accordingly, the distance between the projection part Ap2 and the transparent electrode Yt can be made as same as the thickness of the dielectric layer DL and can be minimized. Thereby, the firing voltage can be further reduced in the discharge generated between the projection part Ap2 and the transparent electrode Yt. As a result, it is possible to further reduce the voltage to be applied between the address electrode AE and the transparent electrode Yt, for example, the above voltage Vsa shown in FIG. 7, in the generation of the address discharge.

The address discharge between the transparent electrode Yt and the projection part Ap2 is generated (early phase discharge) from both sides SD1 and SD2 and an end SD3 (broken line part in FIG. 10) of the projection part Ap2, for example, where electric field strengths are high, and then generated in the periphery expanded from both sides SD1 and SD2 and the end SD3. Since both sides SD1 and SD2 and the end SD3 of the projection part Ap2 contribute to the early phase discharge (discharge inception), a delay time (a discharge time lag) from when voltage is applied to the address electrode AE until the address discharge is generated can be reduced.

As described above, also in the third embodiment, it is possible to obtain the same effect as that of the above first and second embodiments. Further, it is possible to further reduce the voltage to be applied between the address electrode AE and the transparent electrode Yt, for example, the above voltage Vsa shown in FIG. 7 in the generation of the address discharge. Further, since both sides SD1 and SD2 and the end SD3 of the projection part Ap2 contribute to the early phase discharge, it is possible to reduce the discharge time lag in the address period.

Figure 12:
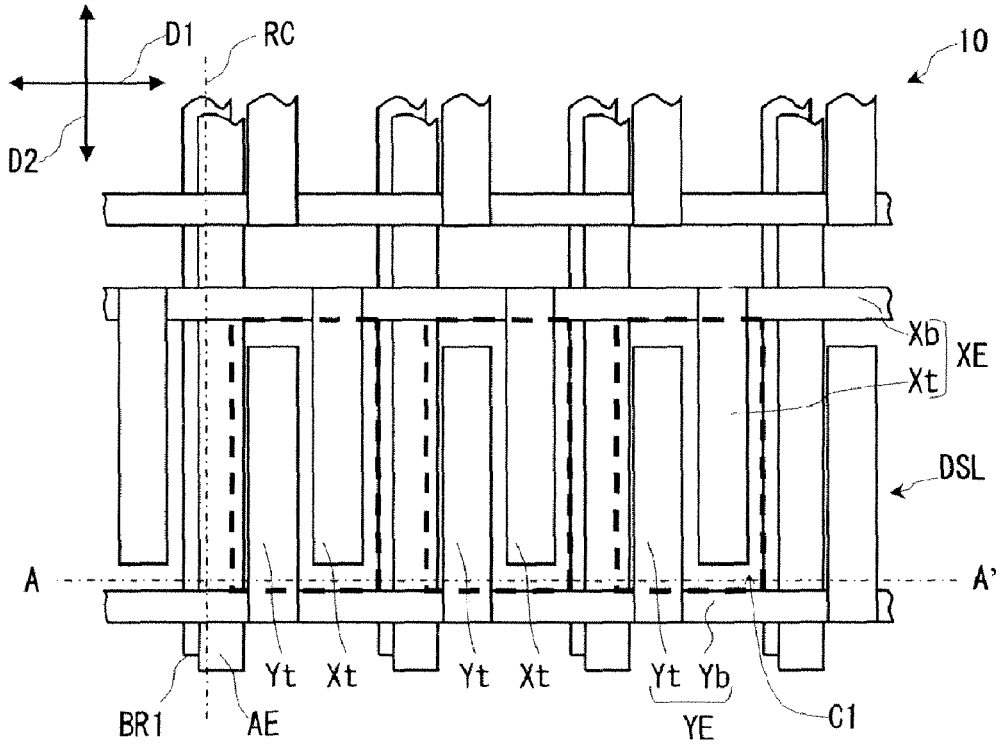
FIG. 12 is an explanatory diagram for a main part of a PDP in a fourth embodiment of the present invention.
Figure 13:
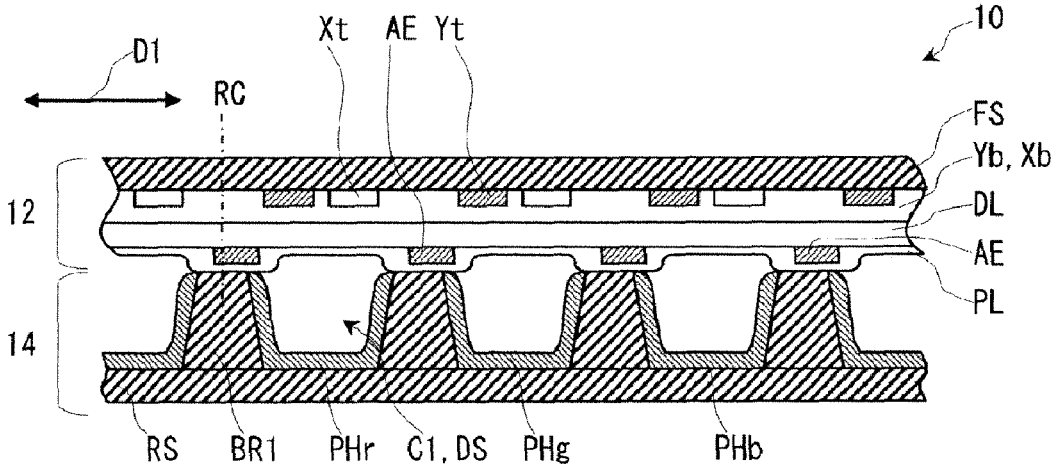
FIG. 13 is a cross-sectional view for a main part of a PDP in the fourth embodiment of the present invention.

FIG. 12 and FIG. 13 show a main part of a PDP in a fourth embodiment of the present invention. This embodiment is different from the first embodiment in the position where the address electrode AE is disposed. The other configuration is the same as that of the first embodiment (FIG. 1 to FIG. 4). The same element as that described in the first embodiment is denoted by the same symbol and detailed description thereof will be omitted. Further, the discharge operation for displaying an image on the PDP 10 of this embodiment and a PDP device using the PDP 10 is the same as that in the first embodiment (FIG. 5 to FIG. 7) except the voltage values (e.g. voltage Vsc and Vsa shown in FIG. 7).

FIG. 12 shows a state of the electrodes Xb, Xt, Yb, Yt, and AE and the barrier rib BR1 viewed from the image display surface side (upper side in FIG. 13), and FIG. 13 shows a cross-section taken along the A-A' line in FIG. 12.

The address electrode AE is disposed nearer to the adjacent transparent electrode Yt side in relation to the center RC of the barrier rib BR1. For example, a part of the address electrode AE is disposed so as to protrude from the barrier rib BR1 to the transparent electrode Yt side. The address electrode AE may be disposed nearer to the transparent electrode Yt side without protruding from the barrier rib BR1 to the transparent electrode Yt side. Thereby, the distance between the address electrode AE and the transparent electrode Yt can be reduced and the firing voltage can be reduced when the discharge is generated between the address electrode AE and the transparent electrode Yt.

As described above, also in the fourth embodiment, it is possible to obtain the same effect as that of the above first embodiment. Further, in this embodiment, the firing voltage can be reduced and thereby it is possible to obtain the same effect as that of the above second embodiment.

Figure 14:
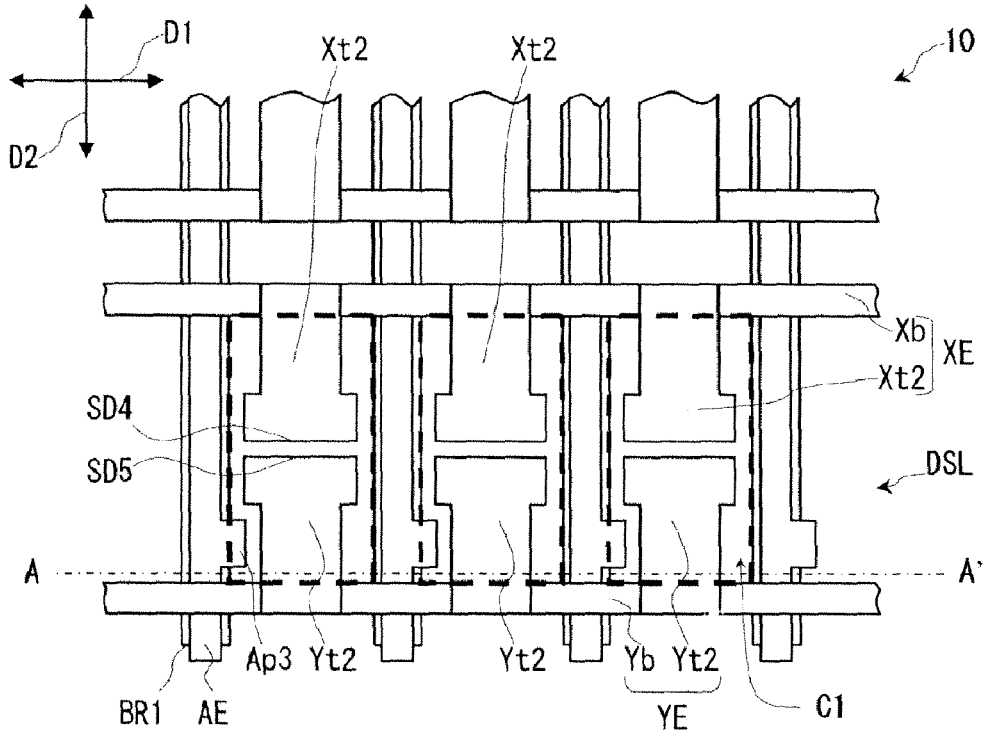
FIG. 14 is an explanatory diagram for a main part of a PDP in a fifth embodiment of the present invention.
Figure 15:
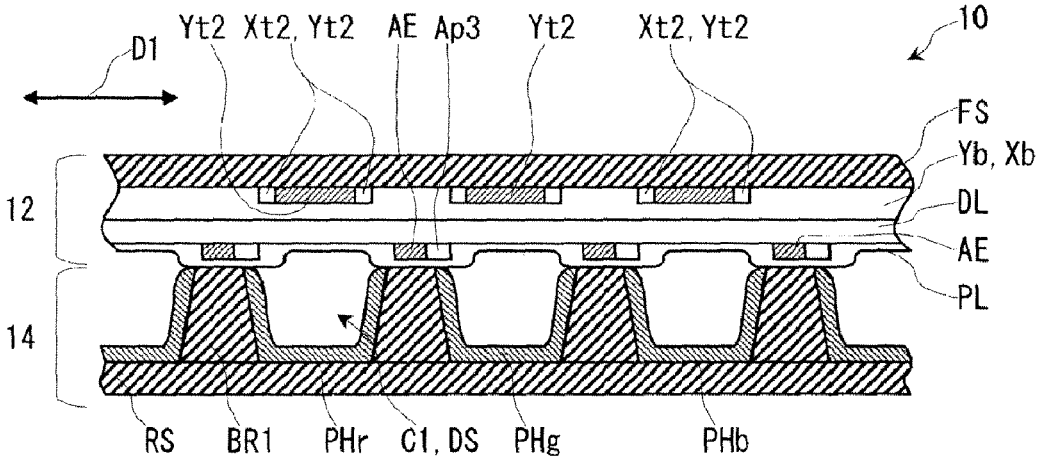
FIG. 15 is a cross-sectional view for a main part of a PDP in the fifth embodiment of the present invention.

FIG. 14 and FIG. 15 show a main part for the PDP 10 in a fifth embodiment of the present invention. This embodiment is different from the first embodiment in the dispositions of the transparent electrodes Xt2 and Yt2 and the projection part Ap3. The other configuration is the same as that of the first embodiment (FIG. 1 to FIG. 4). The same element as that described in the first embodiment is denoted by the same symbol and detailed description thereof will be omitted. Further, the discharge operation for displaying an image on the PDP 10 of this embodiment and a PDP device using the PDP 10 is the same as that of the first embodiment (FIG. 5 to FIG. 7) except the voltage values (e.g. voltages Vsc and Vsa shown in FIG. 7).

FIG. 14 shows a state of the electrodes Xb, Xt2, Yb, Yt2, and AE and the barrier rib BR1 viewed from the image display surface side (upper side in FIG. 15), and FIG. 15 shows a cross-section taken along the A-A' line in FIG. 14.

For each cell C1, the bus electrode Xb is coupled to the transparent electrode Xt2 (first display electrode) which is extended in the second direction D2 from the bus electrode Xb toward the bus electrode Yb. In addition, for each cell C1, the bus electrode Yb is coupled to the transparent electrode Yt2 (second display electrode) which is extended in the second direction D2 from the bus electrode Yb toward the bus electrode Xb. Further, an end SD4 of the transparent electrode Xt2 faces an end SD5 of the transparent electrode Yt2. In addition, the transparent electrodes Xt2 and Yt2 are formed in T-shapes, respectively, for having a wider opposed part. The shapes of the transparent electrodes Xt2 and Yt2 may be rectangular or trapezoidal. In this embodiment, the X-electrode XE (sustain electrode) is configured with the bus electrode Xb and the transparent electrode Xt2 and the electrode YE (scan electrode) is configured with the bus electrode Yb and the transparent electrode Yt2.

Further, the projection part Ap3 is formed integrally with the address electrode AE, projecting from the address electrode AE toward the transparent electrode Yt2 in each cell C1. That is, the projection part Ap3 of the address electrode AE faces the transparent electrode Yt2 of each cell C1. Thereby, by applying a voltage between the address electrode AE and the transparent electrode Yt2, it is possible to generate the address discharge in the discharge space DS of the focused cell C1. The projection part Ap3 of each cell C1 does not face the transparent electrode Yt2 of the adjacent cell C1 via the address electrode AE. This can prevent the erroneous discharge from being generated in the adjacent cell C1.

As described above, also in the fifth embodiment, it is possible to reduce the production process and also to reduce the driving voltage between the scan electrode YE and the sustain electrode XE to suppress the increase in the power consumption, as in the above described first embodiment, since the two dielectric layers need not be formed. In addition, it is possible to reduce the production cost of the PDP 10, as in the above described first embodiment, since a baking process is not necessary for forming the barrier rib BR1, for example.

Further, it is possible to prevent the erroneous discharge from being generated in the adjacent cell C1, since the projection part Ap3 of each cell C1 does not face the transparent electrode Yt2 of the adjacent cell C1 via the address electrode AE.

Figure 16:
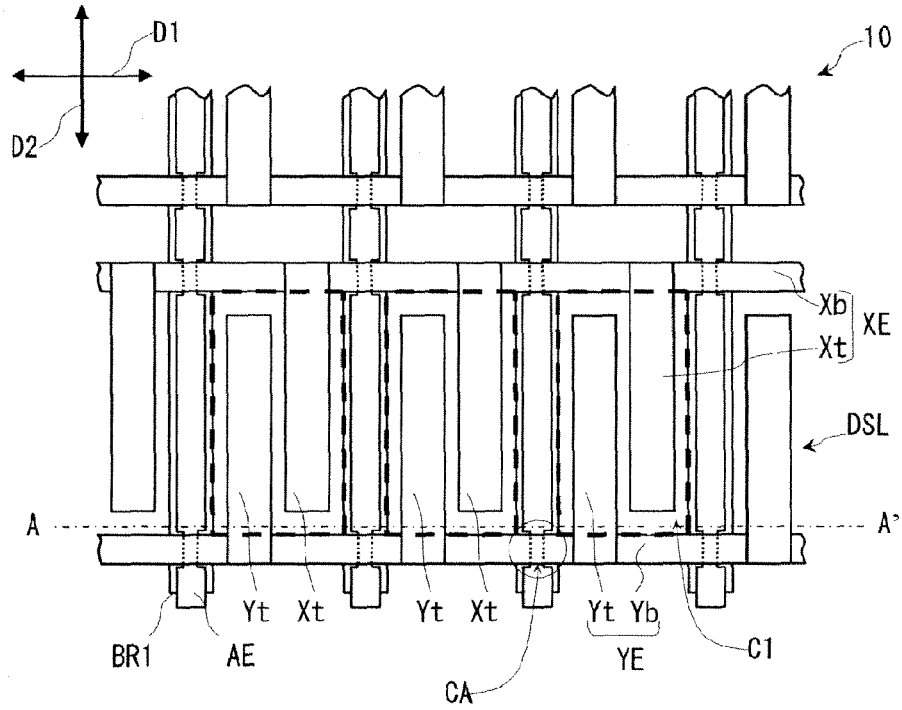
FIG. 16 is an explanatory diagram for a main part of a PDP in a sixth embodiment of the present invention.

FIG. 16 shows a main part of a PDP in a sixth embodiment of the present invention. This embodiment is different from the first embodiment in the line width of a part of the electrodes Xb, Yb, or AE. The other configuration is the same as that of the first embodiment (FIG. 1 to FIG. 4). The same element as that described in the first embodiment is denoted by the same symbol and detailed description thereof will be omitted. Further, the discharge operation for displaying an image on the PDP 10 of this embodiment and a PDP device using the PDP 10 is the same as that in the first embodiment (FIG. 5 to FIG. 7) except the voltage values (e.g. voltage Vsc and Vsa shown in FIG. 7).

FIG. 16 shows a state of the electrodes Xb, Xt, Yb, Yt, and AE and the barrier rib BR1 viewed from the image display surface side (upper side in FIG. 3). Further, the cross-section taken along the A-A' line in FIG. 16 is the same as that in above FIG. 3.

In an intersection area CA where the electrode Xb or Yb and the electrode AE intersect with each other, the address electrode AE is formed with a narrower line width than that of the part excluding the intersection area CA. That is, the bus electrodes Xb and Yb are formed with the same line widths as those in the first embodiment, and only the address electrode AE is formed with a narrower line width in the intersection area CA than that of the part excluding the intersection area CA of the address electrode AE. The bus electrode Xb or Yb may be formed with a narrower line width in the intersection area CA than the line width of the part excluding the intersection area CA. Since the intersection area CA is formed with the narrower line width, it is possible to reduce a wiring capacitance formed between the electrode Xb or Yb and the electrode AE.

As described above, also in the sixth embodiment, it is possible to obtain the same effect as that of the above first embodiment. Further, since the wiring capacitance formed between the electrode Xb or Yb and the electrode AE is smaller in this embodiment, it is possible to save the driving force of the driver circuits for the electrodes Xb and Yb and the electrode AE (e.g. drivers XDRV, YDRV, and ADRV shown in FIG. 5) and to reduce the power consumption.

Figure 17:
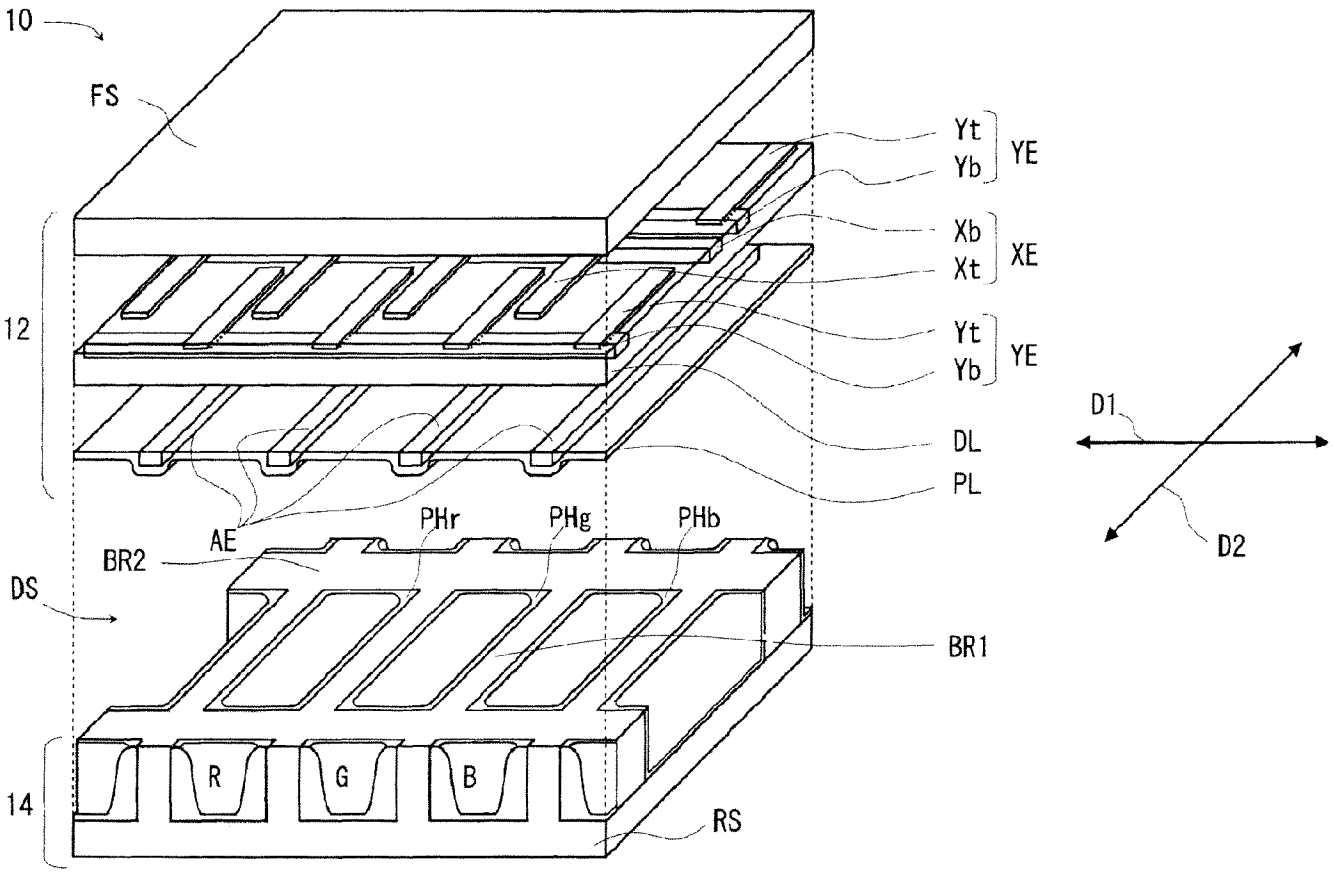
FIG. 17 is an exploded perspective view showing a seventh embodiment of the present invention.

FIG. 17 shows a seventh embodiment of the present invention. This embodiment is different from the first embodiment in that a second barrier rib BR2 is provided on the glass base RS. The other configuration is the same as that of the first embodiment (FIG. 1 to FIG. 4). The same element as that described in the first embodiment is denoted by the same symbol and detailed description thereof will be omitted. Further, the discharge operation for displaying an image on the PDP 10 of this embodiment and a PDP device using the PDP 10 is the same as that in the first embodiment (FIG. 5 to FIG. 7) except the voltage values (e.g. voltages Vsc and Vsa shown in FIG. 7).

The second barrier ribs BR2 are formed on the glass base RS in the first direction D1 and face the bus electrodes Xb and Yb. The side walls of the cell are formed by the barrier ribs BR1 and BR2. That is, the discharge spaces DS of the cells are separated from each other by the barrier ribs BR1 and BR2. Thereby, it is possible to prevent the erroneous discharge in the cell adjacent in the second direction D2.

Figure 18:
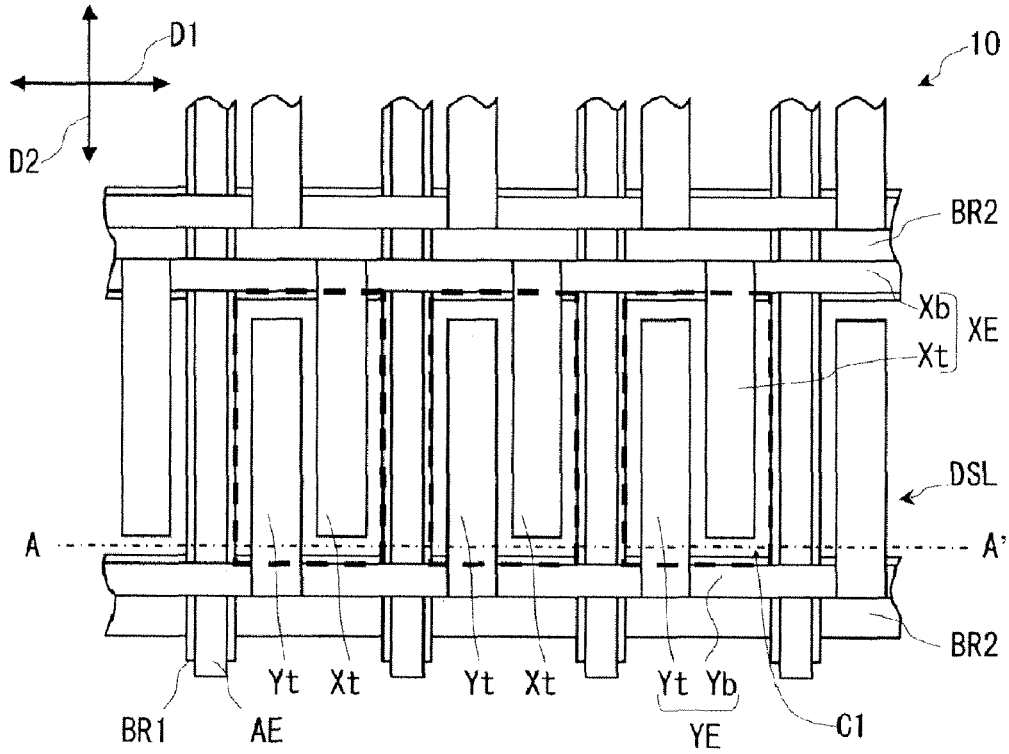
FIG. 18 is an explanatory diagram of a main part in the PDP shown in FIG. 17.
Figure 19:
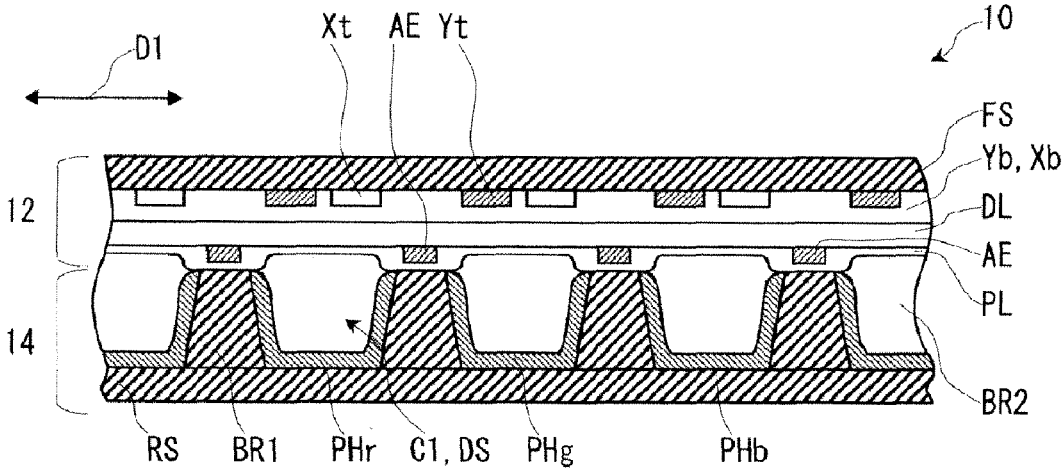
FIG. 19 is a cross-sectional view of a main part in the PDP shown in FIG. 17.

FIG. 18 and FIG. 19 show a main part of the PDP shown in FIG. 17. FIG. 18 shows a state of the electrodes Xb, Xt, Yb, Yt, and AE and the barrier ribs BR1 and BR2 viewed from the image display surface side (upper side in FIG. 19). FIG. 19 show a cross-section taken along the A-A' line in FIG. 18.

When viewed from the image display surface side, the bus electrodes Xb and Yb are provided at positions overlapping the barriers BR2. The cell C1 is formed in a region surrounded by the barrier ribs BR1 and BR2 (region surrounded by the bold broken line in FIG. 18). Since the bus electrodes Xb and Yb are disposed on the barrier ribs BR2, the erroneous discharge between the bus electrodes Xb and Yb adjacent in the second direction D2 can be prevented. That is, it is possible to prevent the erroneous discharge in the cell adjacent in the second direction D2. Thereby, it is possible to reduce the distance between the bus electrodes Xb and Yb and to increase the area of each cell C1.

Figure 20:
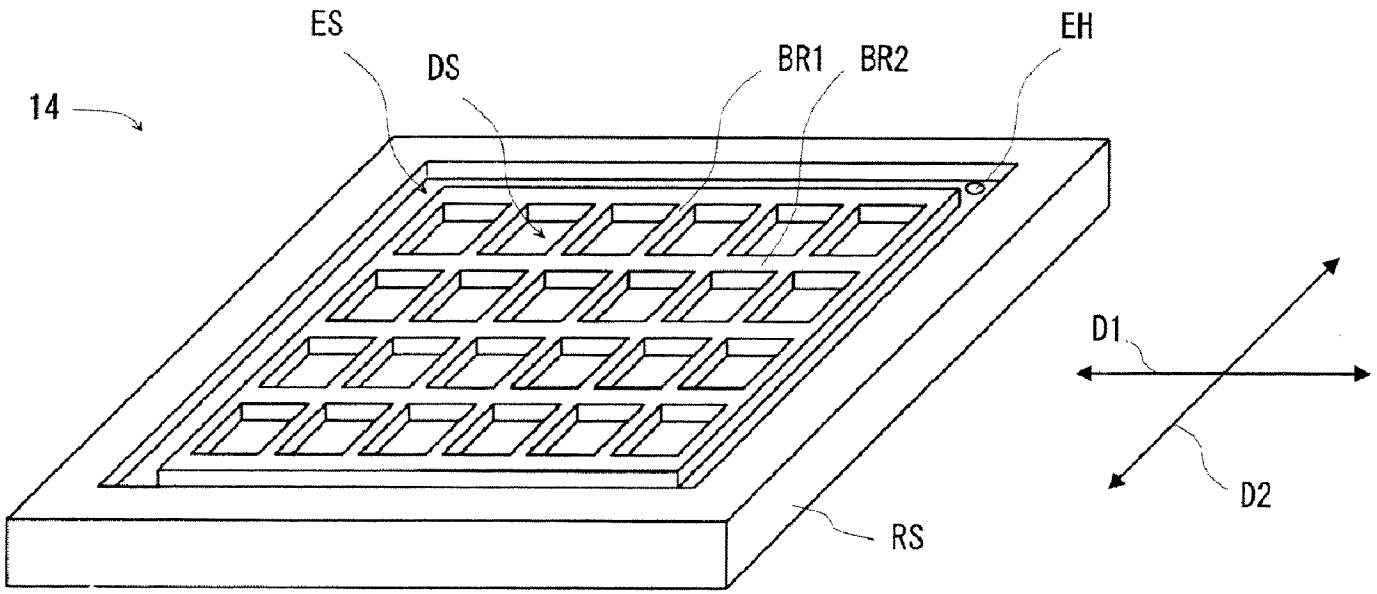
FIG. 20 is an explanatory diagram showing an outline of the back plate part shown in FIG. 17.

FIG. 20 shows an outline of the back plate part 14 shown in FIG. 17. The same element as that described in above FIG. 4 is denoted by the same symbol and detailed description thereof will be omitted.

The barrier ribs BR1 and BR2 are formed by the direct engraving of the glass base RS by the sandblast method or the like. That is, the barrier rib BR2 is formed integrally with the barrier rib BR1.

As described above, also in the seventh embodiment, it is possible to obtain the same effect as that of the above first embodiment. Further, since the cells C1 are separated from each other by the barrier ribs BR1 and BR2 in this embodiment, it is possible to prevent the erroneous discharge in each of the cells adjacent in the four directions.

Note that the above embodiments describe the examples in which one pixel is configured with three cells (red (R), green (G), and blue (B)). The present invention is not limited to such embodiments. For example, one pixel may be configured with four or more cells. Alternatively, one pixel may be configured with cells which emit colors except red (R), green (G) and blue (B), and also may include a cell which emits a color except red (R), green (G), and blue (B).

Figure 21:
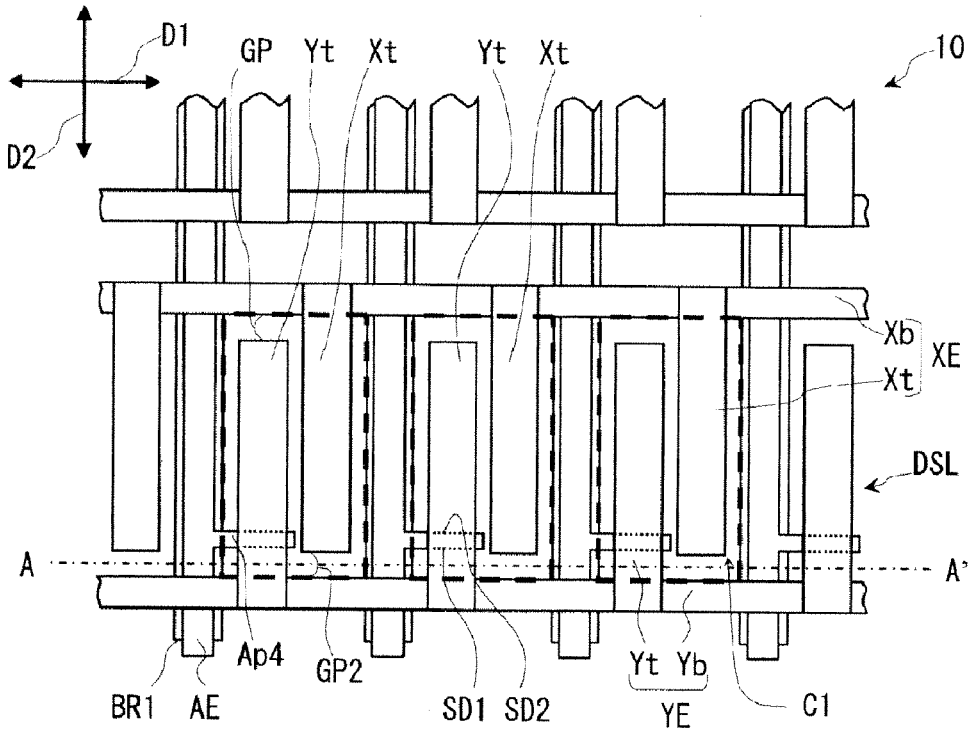
FIG. 21 is an explanatory diagram for a main part of a PDP in a modification example of the present invention.

The above second and third embodiments describe the examples in which the projection parts Ap and Apt project toward the gap GP and the gap GP2, respectively. The present invention is not limited to such embodiments. For example, as shown in FIG. 21, the projection part Ap4 may be formed projecting from the address electrode AE toward a part except the gap GP and the gap GP2 on the transparent electrode Yt side of each cell C1. Further, an end of the projection part Ap4 may protrude from the transparent electrode Yt as shown in FIG. 21.

Figure 22:
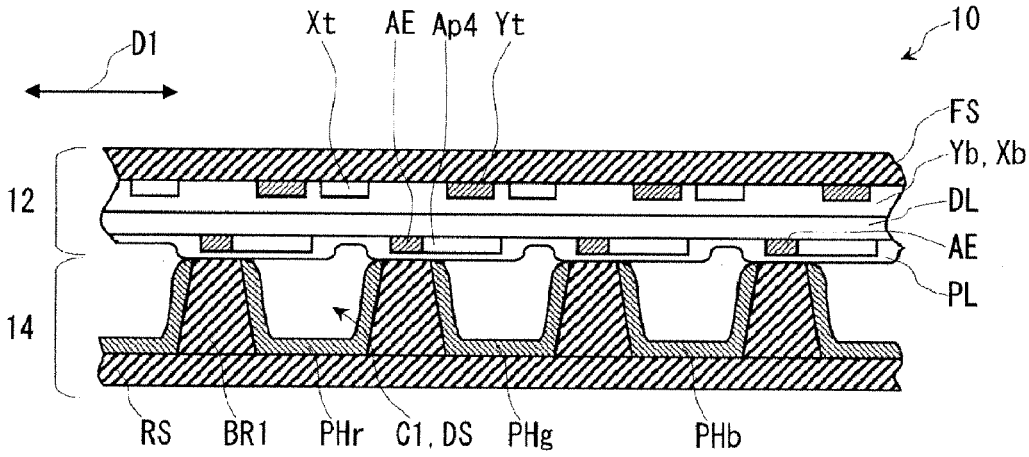
FIG. 22 is a cross-sectional view for a main part of a PDP in a modification example of the present invention.

FIG. 21 shows a main part of the PDP 10 viewed from the image display surface side (upper side in FIG. 22), and FIG. 22 shows a cross-section taken along the A-A' line in FIG. 21. As described above, the disposition of the projection part Ap4 provided to the address electrode AE is different from those of the second and third embodiments. The other configuration is the same as those of the second and third embodiments. The same element as that described in the second and third embodiments is denoted by the same symbol, and detailed description thereof will be omitted. Also in this case, it is possible to obtain the same effect as those of the above described second and third embodiments.

The above second, third, and fifth embodiments describe the examples in which the projection parts Ap, Ap2, and Ap3 are formed integrally with the address electrodes AE, respectively. The present invention is not limited to such embodiments. For example, the projection parts Ap, Ap2, Ap3 and Ap4 shown in FIG. 21 may be formed by transparent electrodes coupled to the address electrodes AE, respectively. Also in this case, it is possible to obtain the same effect as those of the above described second, third, and fifth embodiments. Further, it is possible to widen the transmission region of light in each cell, since the projection parts Ap, Ap2, Ap3, and Ap4 are formed by the transparent electrodes.

The above sixth embodiment describes the example in which the electrodes Xb, Yb, and AE have the narrower line widths formed in the intersection area CA of the PDP 10 having the transparent electrodes Xt and Yt disposed alternately along the first direction D1. The present invention is not limited to such an embodiment. For example, the intersection area between the electrodes Xb or Yb and the electrode AE may be formed with a narrower line width in the PDP 10 shown in above FIG. 14 (PDP having the transparent electrodes Xt2 and Yt2 in which the ends SD4 and SD5 face each other). Also in this case, it is possible to reduce the driving force of the driver circuits for the electrodes Xb, Yb and AE (e.g. drivers XDRV, YDRV, and ADRV shown in FIG. 5) further to reduce the power consumption. Further, it is possible to obtain the same effect as that of the above fifth embodiment.

The above seventh embodiment describes the example in which the second barrier rib BR2 is provided to the PDP 10 having the transparent electrodes Xt and Yt disposed alternately along the first direction D1. The present invention is not limited to such an embodiment. For example, the second barrier ribs BR2 facing the bus electrodes Xb and Yb may be formed on the glass base RS of the PDP 10 shown in above FIG. 14. Also in this case, the cells C1 are separated from each other by the barrier ribs BR1 and BR2, and thereby it is possible to prevent the erroneous discharge in each of the cells adjacent in the four directions. Further, it is possible to obtain the same effect as that of the above fifth embodiment.

The many features and advantages of the embodiments in the present disclosure are apparent from the detailed specification and, thus it is intended by the appended claims to cover all such features and advantages of the embodiments that fall within the true spirit and scope thereof. Further, since numerous modifications and changes will readily occur to those skilled in the art, it is not desired to limit the inventive embodiments to exact construction and operation illustrated and described, and accordingly all suitable modifications and equivalents may be resorted to, falling within the scope thereof.

The invention claimed is:

1. A plasma display panel, comprising:

a first plate and a second plate facing each other via a discharge space;

a first bus electrode and a second bus electrode extending in a first direction and disposed at intervals on the first plate;

a plurality of first barrier ribs extending in a second direction perpendicular to the first direction and disposed at intervals on the second plate;

a cell formed in a region surrounded by the first bus electrode, the second bus electrode, and two of the first barrier ribs adjacent to each other;

a first display electrode being rectangularly shaped, disposed in the cell, coupled to the first bus electrode, and extending from the first bus electrode toward the second bus electrode;

a second display electrode being rectangularly shaped, disposed in the cell, coupled to the second bus electrode, extending from the second bus electrode toward the first bus electrode, and including an opposed part to the first display electrode along the second direction;

a dielectric layer provided on the first plate and covering the first bus electrode, the second bus electrode, the first display electrode, and the second display electrode;

a plurality of address electrodes provided on the dielectric layer and disposed at respective positions facing the first barrier ribs; and a protective layer being directly formed on the address electrodes and the dielectric layer, covering a surface of the dielectric layer and the address electrodes, and being exposed to the discharge space of the cell.

2. The plasma display panel according to claim 1, further comprising a projection part projecting from each of the address electrodes toward a side of the second display electrode in the cell and directly covered by the protective layer.

3. The plasma display panel according to claim 2, wherein:

the first display electrode and the second display electrode are disposed alternately, and the projection part is projected into a gap between an end of the second display electrode and the first bus electrode.

4. The plasma display panel according to claim 2, wherein:

the first display electrode and the second display electrode are disposed alternately, and the projection part is projected toward a gap between an end of the first display electrode and the second bus electrode.

5. The plasma display panel according to claim 1, wherein:

the first display electrode and the second display electrode are disposed alternately, and one of the address electrodes is disposed nearer to the second display electrode adjacent to the one of the address electrodes in relation to a center of one of the first barrier ribs.

6. The plasma display panel according to claim 1, wherein the dielectric layer is formed of a silicon dioxide film.

7. The plasma display panel according to claim 1, wherein at least one electrode of the first bus electrode, the second bus electrode, and one of the address electrodes has a narrower line width in an intersection area where each of the first bus electrode and the second bus electrode intersects the one of the address electrodes than a line width of the electrode excluding the intersection area.

8. The plasma display panel according to claim 1, further comprising second barrier ribs disposed on the second plate at respective positions facing the first bus electrode and the second bus electrode.

* * * * *